US008136249B2

(12) United States Patent
Shiba

(10) Patent No.: US 8,136,249 B2
(45) Date of Patent: Mar. 20, 2012

(54) LOCKING DEVICE

(75) Inventor: Shinji Shiba, Matsumoto (JP)

(73) Assignee: Izumi Products Company, Nagano (JP)

( * ) Notice: Subject to any disclaimer, the term of this patent is extended or adjusted under 35 U.S.C. 154(b) by 683 days.

(21) Appl. No.: 11/891,546

(22) Filed: Aug. 10, 2007

(65) Prior Publication Data

US 2008/0052883 A1 Mar. 6, 2008

(30) Foreign Application Priority Data

Aug. 11, 2006 (JP) ..... 2006-220054

(51) Int. Cl.
*B26B 19/04* (2006.01)

(52) U.S. Cl. ..... 30/43.92; 30/34.1; 30/346.51

(58) Field of Classification Search ..... 30/532, 30/43.92, 43.91, 43.9, 40.2, 41, 41.6, 43.1, 30/43.6, 43.2, 51, 54, 55, 79; 4/532, 43.92, 4/43.91, 43.9, 40.2, 41, 41.6, 43.1, 43.6, 4/43.2, 51, 54, 55, 79, 346.51, 34.1
See application file for complete search history.

(56) References Cited

U.S. PATENT DOCUMENTS

| | | | | |
|---|---|---|---|---|
| 2,661,531 | A * | 12/1953 | Streng | 30/41.6 |
| 3,105,298 | A * | 10/1963 | Carissimi | 30/43.92 |
| 3,562,566 | A | 2/1971 | Kircher | |
| 3,783,508 | A * | 1/1974 | Brown et al. | 30/43.92 |
| 4,581,822 | A | 4/1986 | Fujimura | |
| 4,631,825 | A * | 12/1986 | Kuriyama et al. | 30/43.92 |
| 6,082,005 | A * | 7/2000 | Tezuka | 30/43.92 |
| 6,205,666 | B1 * | 3/2001 | Junk | 30/43.92 |
| 7,464,471 | B2 * | 12/2008 | Fukutani et al. | 30/43.91 |
| 2005/0143755 | A1 * | 6/2005 | Hashiguchi et al. | 606/135 |
| 2006/0283018 | A1 * | 12/2006 | Oh | 30/45 |

FOREIGN PATENT DOCUMENTS

| | | |
|---|---|---|
| EP | 1174228 | 1/2002 |
| EP | 1366869 | 12/2003 |
| EP | 1676680 | 7/2006 |
| JP | 06-218154 | 8/1994 |
| JP | 10-323461 | 12/1998 |
| JP | 2004-049864 | 2/2004 |
| JP | 2004-248979 | 9/2004 |

* cited by examiner

*Primary Examiner* — Laura M. Lee
(74) *Attorney, Agent, or Firm* — DLA Piper LLP (US)

(57) ABSTRACT

A locking device for securing an attachment member to a main body including first engagement pawls provided in the attachment member so that the first engagement pawls extend in the direction of attachment-detachment of the attachment member and along the inner surface of the main body and a push button assembly secured to the inner surface of the main body. The push button assembly includes a back panel for being secured to an inner surface of the main body, a push button for protruding through an opening in the main body, second engagement pawls formed on the push button and a compression spring provided between the push button and the back panel.

3 Claims, 9 Drawing Sheets

LOCKING DEVICE

BACKGROUND OF THE INVENTION

1. Field of the Invention

The present invention relates to a locking device for securing an attachment member to a main body and more particularly to a locking device suitable for a reciprocating electric shaver for shaving, for instance, face whiskers ("hair") by causing an inner cutter(s) to move reciprocally while being pressed against the inner surface of an outer cutter(s) that is substantially inverted-U-shaped when viewed from the side.

2. Description of the Related Art

Reciprocating electric shavers are commonly known. Generally, reciprocating electric shavers are made so that an inner cutter is caused to move reciprocally while it is being pressed against the inner surface of an outer cutter that is substantially inverted-U-shaped when seen from the side, and hair coming through the slits provided in the outer cutter is cut by the reciprocating inner cutter.

Japanese Patent Application Laid-Open (Kokai) Nos. 2004-49864 and H10 (1998)-323461, discloses reciprocating electric shavers, and in these shavers, an outer cutter assembly that is held so that the outer cutter can freely sink in, in the up and down direction, is detachably locked to the shaver main body which houses therein a motor. More specifically, in this shaver, an oscillator is provided in the main body and vibrated by the motor, and the inner cutter is held on the oscillator in such condition that it is capable of swinging and is urged upward by an inner cutter upwardly pushing spring, so that the inner cutter moves reciprocally while being pressed against the inner surface of the outer cutter by a prescribed spring force.

The locking device disclosed in the above relevant art that is for attaching and detaching the outer cutter assembly to and from the main body is designed so that it engages and disengages a push button, provided so that it can be pressed in from the side of the main body and is capable of returning, with engagement pawls provided in the outer cutter assembly. More specifically, a push button return spring is compressed and installed between the push button and parts installed inside the main body, and a return force toward the outside of the main body is imparted to the push button by this return spring, so that a locked condition occurs when the push button is made to return, and the lock is released when the push button is pushed in.

In such a conventional locking device, when assembling the shaver main body, it is necessary to mount the return spring in between the parts installed inside the main body while mounting the push button in the opening of the main body casing. Accordingly, the installation of such parts in the main body and the installation of the locking device must be performed in parallel, making the assembly work of shavers inefficient. This has been a problem.

In addition, the spring load of the push button return spring acts on the inner surface of the main body casing and on the parts installed inside the main body; accordingly, it is necessary to reinforce the positions on the inner surface of the main body casing and on the parts mounted inside the main body where that return spring load acts. For that purpose, reinforcing ribs or hubs must be provided at those positions, and the material of the parts must be large in thickness to enhance their rigidity. When those parts are molded products made of resins (plastics), limitations arise on the shapes of the parts in terms of the structure of the molding dies, and thus design freedom declines, which is also a problem.

BRIEF SUMMARY OF THE INVENTION

Accordingly, an object of the present invention, devised in view of the above-described circumstances, is to provide a locking device in which the locking device can be assembled irrespective of assembly of a main body of, for instance, an electric shaver, thus enhancing assembly work efficiency, and in which a push button return spring load is prevented from acting on the main body casing or on the parts installed inside the main body, making it unnecessary to provide reinforcing ribs or the like in the shaver main body casing or in the parts mounted inside the main body, and further in which molding die design freedom can be increased.

The above object is accomplished by a unique structure of the present invention for a locking device for securing an attachment member to a main body, and this locking device includes:

- first engagement pawls provided in one of the attachment member and main body so that the first engagement pawls extend parallel to the direction of attachment-detachment of the attachment member and along the inner surface of the other of the attachment member and main body; and
- a push button assembly secured to the inner surface of one of the attachment member and main body and provided with second engagement pawls that are engaged to and disengaged from the first engagement pawls; and
- the push button assembly is comprised of:
  - a back panel secured to the inner surface of the other of the attachment member and main body,
  - a push button capable of protruding from an opening provided in the other of the attachment member and main body, the push button engaging with the back panel, an amount of protrusion thereof being limited, and the second engagement pawls being formed thereon, and
  - a push button return spring that is compressed and installed (or installed in a compressed manner) between the back panel and push button.

In the locking device of the present invention, a push button assembly is formed by compressing and mounting a push button return spring between a push button and a back panel, and the push button and the back panel are engaged with each other so as to limit the amount by which the push button protrudes, and the thus structured push button assembly is mounted by securing the back panel thereof to the inner surface of either the main body or the attachment member. Accordingly, the locking device can be assembled irrespective of the assembly of the parts installed in the main body, and assembly work efficiency is enhanced. In addition, because the push button return spring load is received by the back panel and push button, there is no longer any necessity of providing reinforcing ribs or hubs for taking such loads in the main body casing or in the parts in the main body or the like, and molding die design freedom increases.

The locking device of the present invention is suitable to be used as a locking device for attaching and detaching an outer cutter assembly of a reciprocating electric shaver to and from the main body casing of the shaver that houses therein a motor, a battery or the like. However, the present invention is applicable to other appliances and machines. In other words, it is possible to apply the locking device of the present invention to an attachment-detachment unit in an electric hair clipper, face shaver, electric toothbrush or the like.

When the locking device of the present invention is to be applied to an electric shaver, the locking device is configured such that the first engagement pawls are provided in the outer cutter assembly so as to extend from the open edge of the main body casing along an inner surface of the main body casing;

the second engagement pawls of the push button assembly are substantially perpendicular to the direction of attachment and detachment of the outer cutter assembly and protrude in a direction along the inner surface of the main body casing;

the first engagement pawls, guided along the inner surface of the main body casing, intrude into a gap between the inner surface of the main body casing and the second engagement pawls, compress the push button return spring, and engaged with the second engagement pawls while push-opening the gap; and the second engagement pawls and the first engagement pawls are disengaged from each other when the push button is pushed.

In the above structure, guide channels can bee formed in the inner surface of the main body casing for guiding the first engagement pawls into the gap between the main body casing inner surface and the second engagement pawls. With such guide channels, the engagement and disengagement of the first engagement pawls and the second engagement pawls can be performed smoothly.

DETAILED DESCRIPTION OF THE INVENTION

Figure 1:
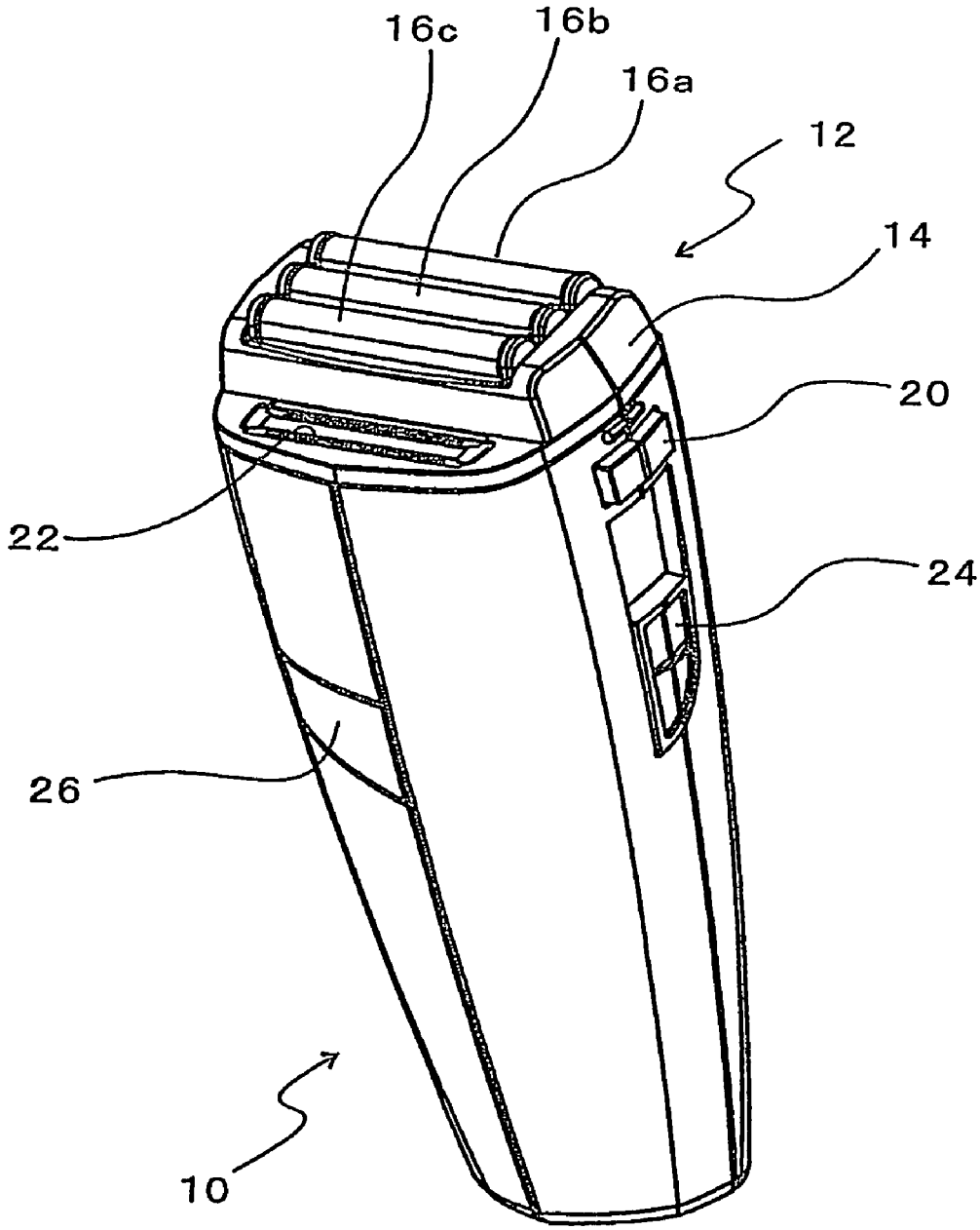
FIG. 1 is an external perspective view of a reciprocating shaver according to one embodiment of the present invention.
Figure 2:
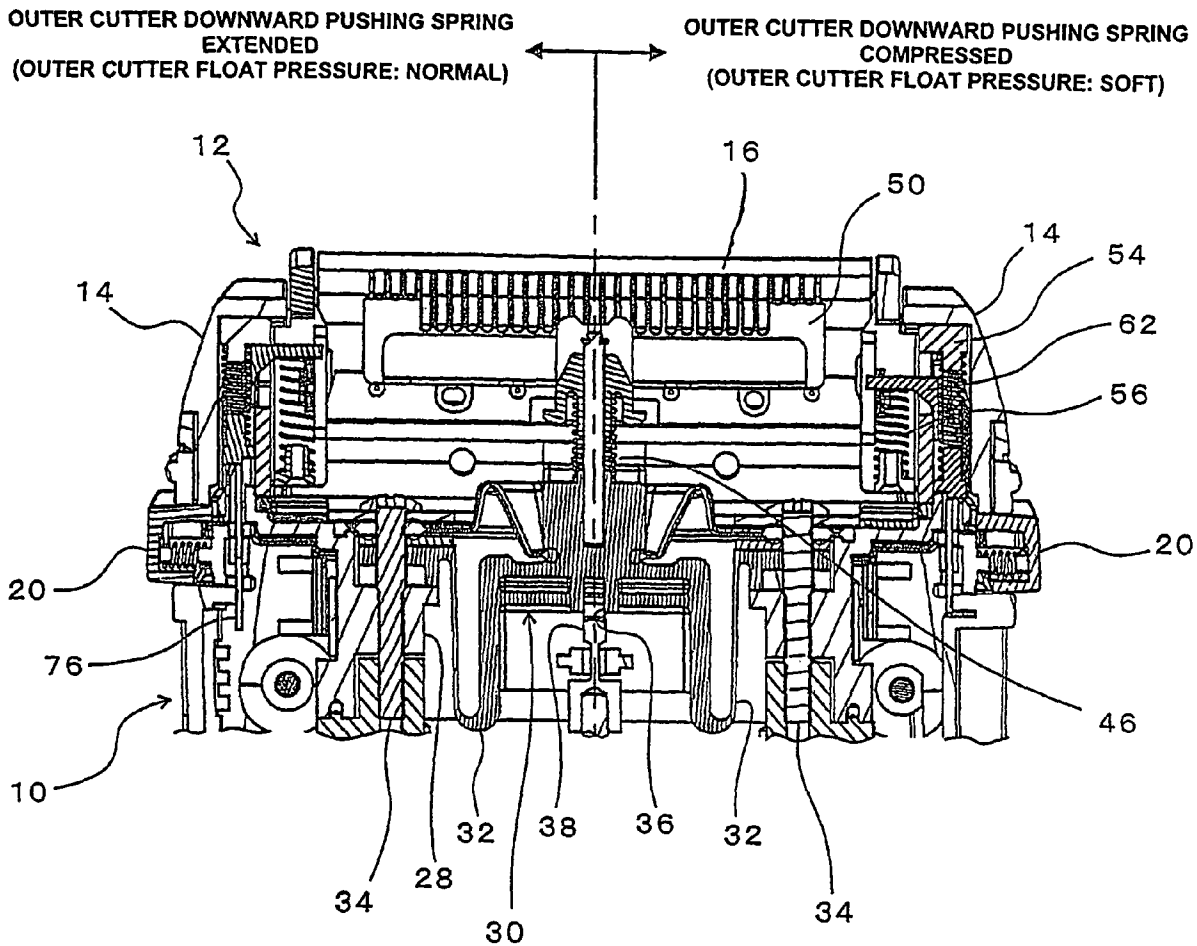
FIG. 2 is a vertical section of the shaver head unit thereof.
Figure 3A:
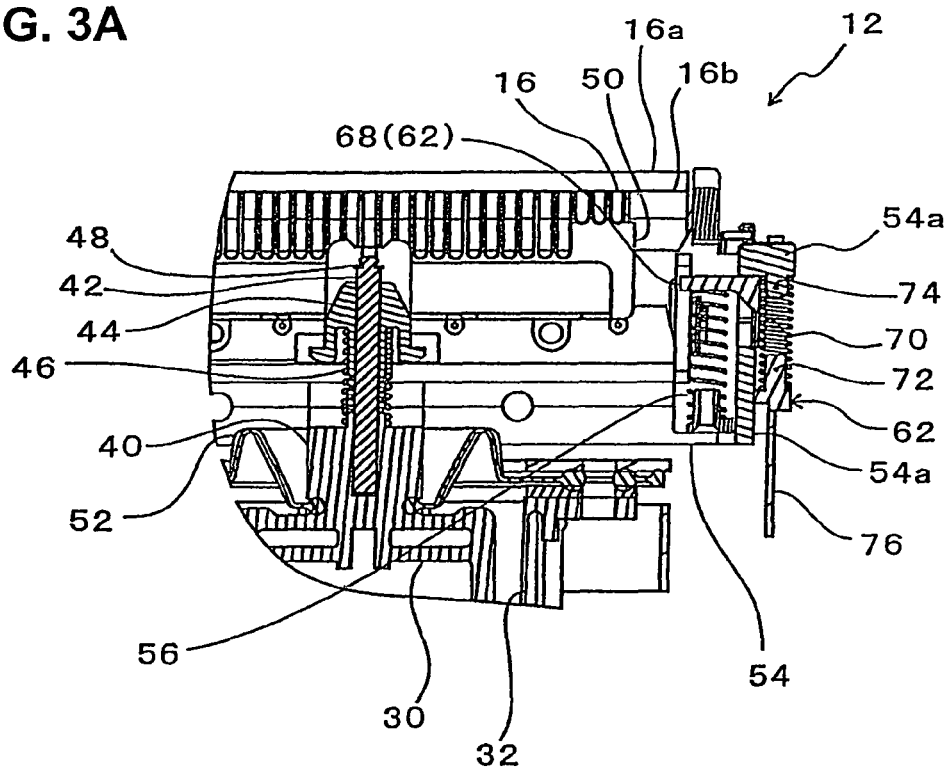
FIGS. 3A and 3B are enlarged views, in cross section, of a part of the shaver head unit of FIG. 2.
Figure 3B:
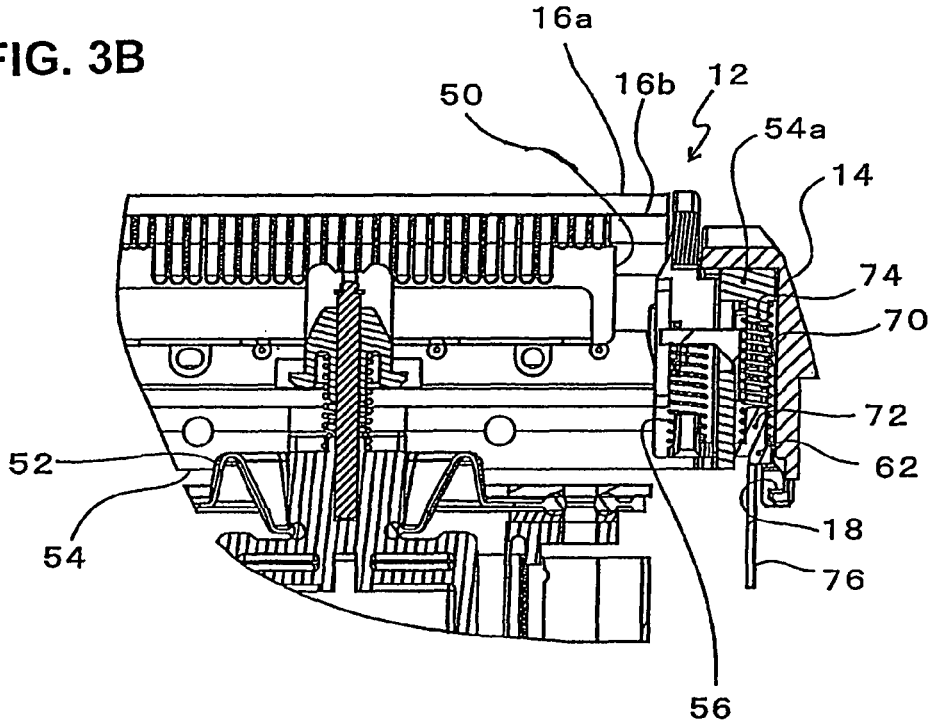
Figure 4:
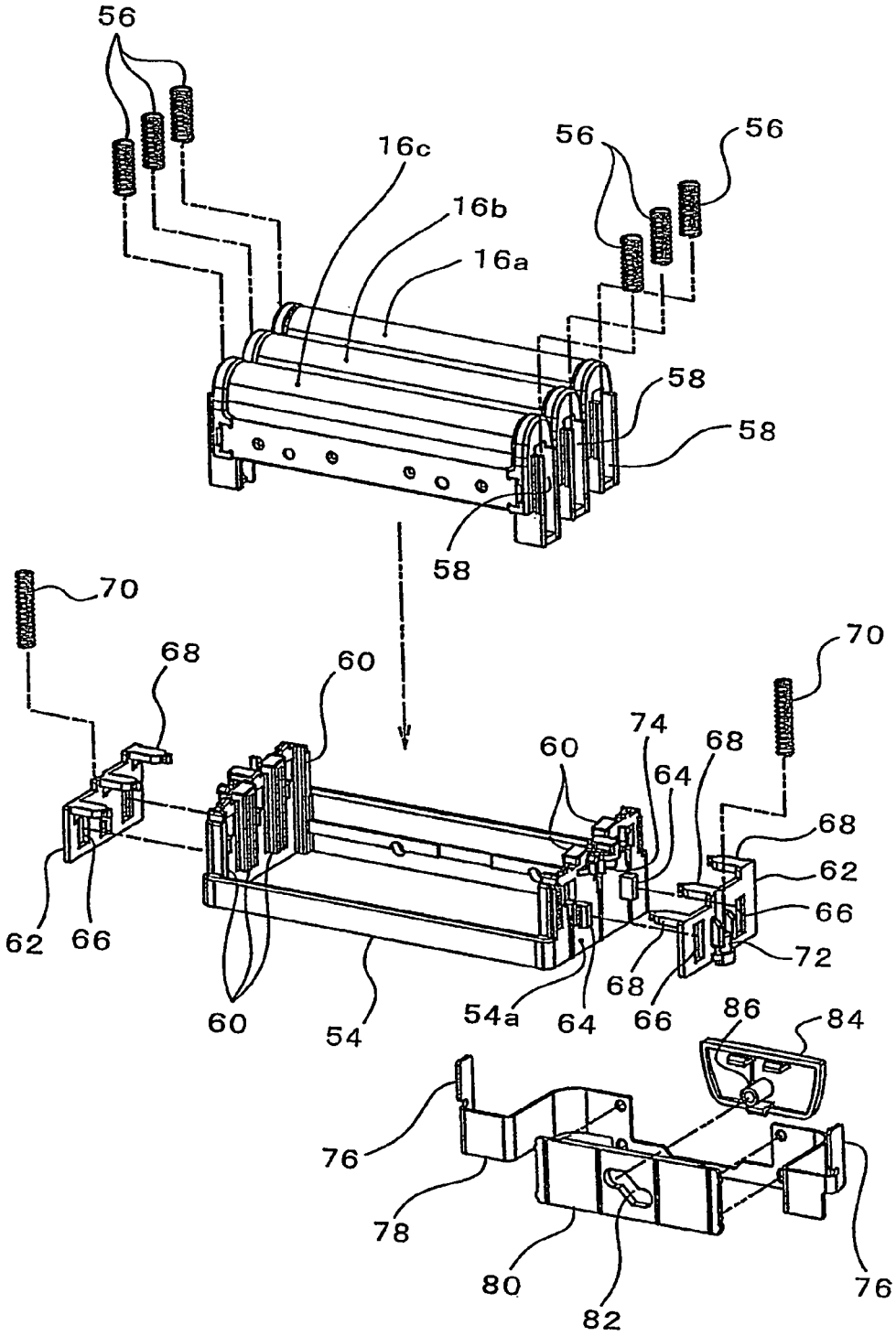
FIG. 4 is an exploded perspective view of the shaver head unit.
Figure 5:
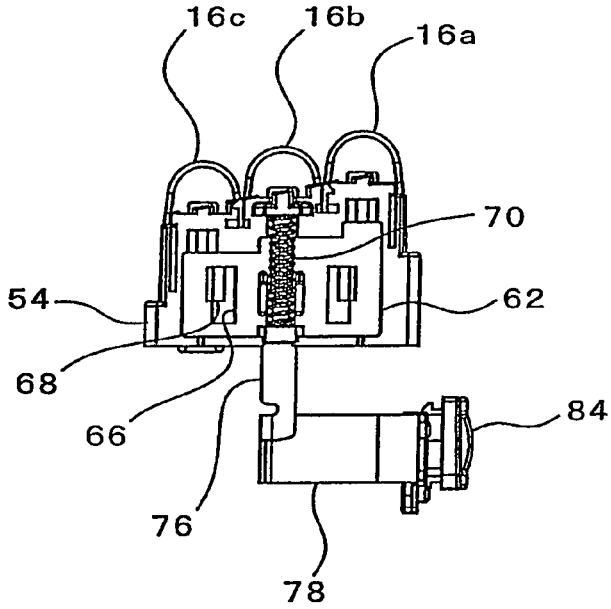
FIG. 5 is a side elevation of an adjustment mechanism for a float setting member.
Figure 6:
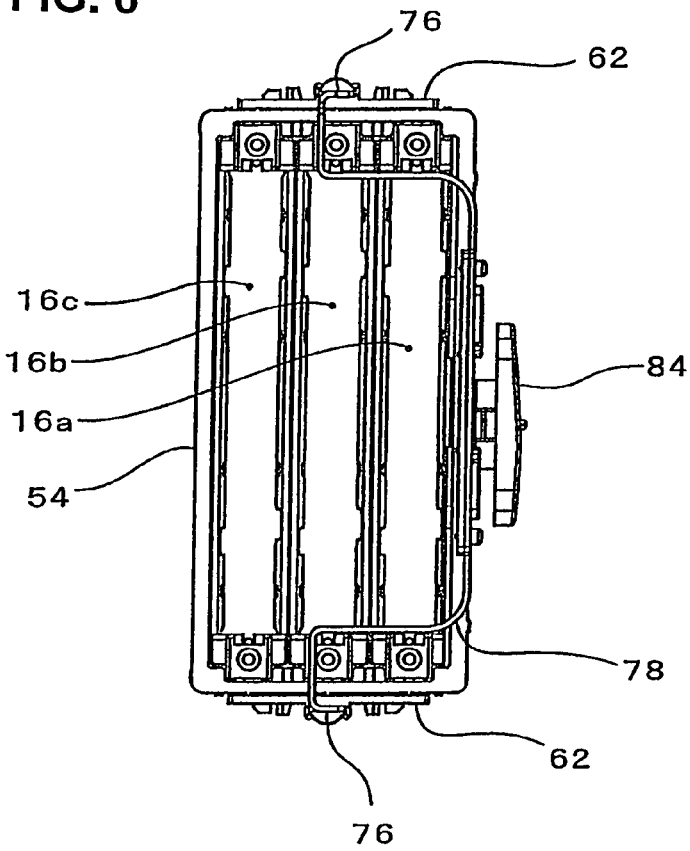
FIG. 6 is a bottom view of the same.
Figure 7:
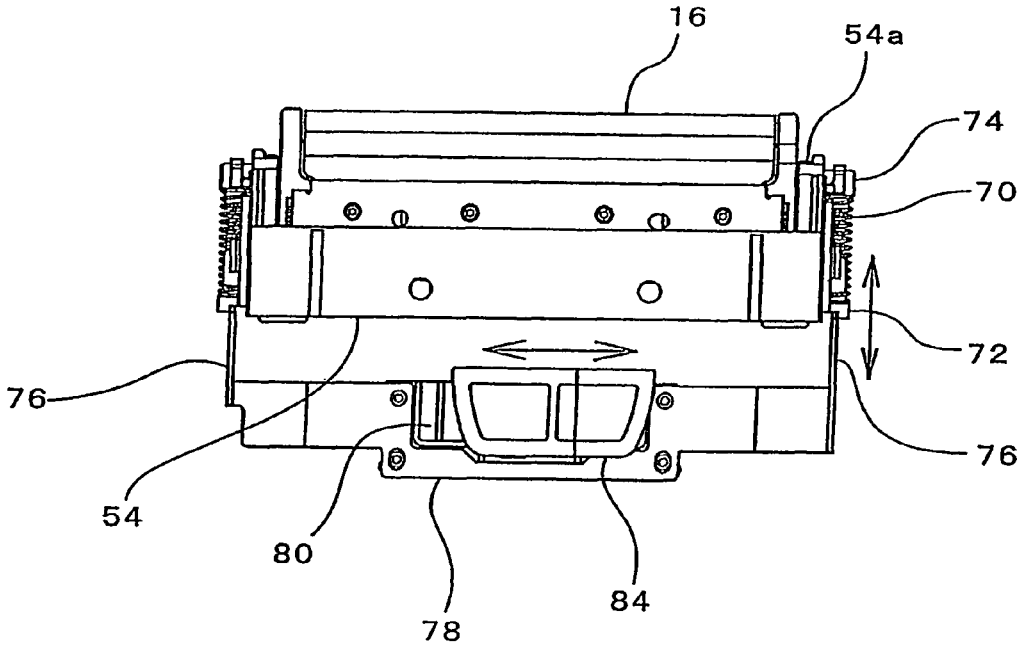
FIG. 7 is a rear view of the same.

FIG. 1 is a perspective view of the reciprocating shaver according to one embodiment of the present invention, while FIG. 2 is a vertical section of the shaver head unit of this shaver. In FIG. 2, a condition in which the outer cutter float pressure is made either strong or ordinary (normal) is illustrated on the left half of the drawing, and a condition in which the outer cutter float pressure is made weak (soft) is illustrated on the right half of the drawing. FIG. 3A, a partial view of FIG. 2, shows the situation in which the outer cutter float pressure is made strong (normal), and FIG. 3B, another partial view of FIG. 2, shows the situation in which the outer cutter float pressure is made weak (i.e. soft, corresponding to the right half of FIG. 2). FIG. 4 shows the shaver head unit disassembled, and FIG. 5 shows the detail of a mechanism for adjusting the height of a slide member by a manual manipulator. FIG. 6 is a bottom view of the slide member height adjusting mechanism and FIG. 7 is a rear view thereof.

In FIG. 1, the reference numeral 10 is a main body of the shaver of the present invention, and this shaver main body 10 houses in its main body casing 11 a battery, an electric motor, a control circuitry and other required shaver components (not shown in FIG. 1). An outer cutter assembly 12 is detachably attached from above to the upper end of the shaver main body 10. The outer cutter assembly 12 includes three outer cutters 16*a*, 16*b* and 16*c* (shown by "16*a* to 16*c*" or merely by "16" in the description below) that are installed in parallel inside a head cover 14 (see FIG. 2) and so as to make up and down motions. In the head cover 14, four first engagement pawls 18 (see FIG. 3B) are provided to protrude downward, while shaver head attachment-detachment buttons ("shaver head buttons") 20 imparted with a tendency to return so as to protrude to the outside are mounted on the left and right side surfaces of the shaver main body 10. Second engagement pawls (not shown) formed in the shaver head buttons 20 are provided so as to be engaged with and disengaged from the first engagement pawls 18.

The head cover 14 covers the upper surface (upper end) of the shaver main body 10 except a part on its front side, so that that part of the upper portion of the shaver main body 10 on the front side is exposed. That exposed portion accommodates a fine shaving blade 22. More specifically, the fine shaving blade 22 is provided to protrude upward by a manipulator 24 provided in the shaver main body 10. When using the fine shaving blade 22, the manipulator 24 is pushed upward to make the fine shaving blade 22 protrude upward. In FIG. 1, the fine shaving blade 22 is retracted in the shaver main body 10. The reference numeral 26 in FIG. 1 is an electrical power switch. When the electrical power switch is pressed once, the motor in the shaver main body 10 starts running, and when it is pressed once more, the motor stops.

In FIG. 2, the reference numeral 28 is an inner block secured on the inside of the upper part of the shaver main body 10, while 30 is an oscillator mounted in an opening in the inside block 28. The left and right edges of the oscillator 30 are secured by screws 34, through U-shaped flexible connectors 32. In the lower center surface of the oscillator 30, an elongated channel 36 is formed, long in the direction perpendicular to the drawing surface of FIG. 2. Into this long channel 36, a vibrating shaft 38 which moves eccentrically by the rotational power of the motor is engaged. As a consequence, when the motor runs, the oscillator 30 vibrates to the left and right in FIG. 2.

An inner cutter holder 40 protrudes out at the center of the upper surface of the oscillator 30, and a vertical shaft 42 is secured to the inner cutter holder 40. In this vertical shaft 42, a slider 44 is provided so that it can freely slide up and down. A coil spring 46 is compressed and installed (or installed in a compressed manner) between the slider 44 and the inner cutter holder 40 of the oscillator 30, so that a tendency to return upward is imparted to the slider 44. The coil spring 46, as will be described in detail below, is a spring that will constitute an inner cutter upwardly pushing spring in the present invention. The slider 44, moreover, is prevented from sliding completely off the vertical shaft 42 by a stopper 48 provided at the upper end of the vertical shaft 42.

The reference numeral 50 refers to inner cutters that respectively slide against the inner surfaces of the three outer cutters 16. The inner cutters 50 are provided so that they can swing left and right by the slider 44 and are capable of being oscillated sideways (left and right) by the oscillator 30. Though three inner cutters 50, respectively corresponding to the three outer cutters 16*a* to 16*c*, are provided, only one is shown in FIGS. 2, 3A and 3B. Also, a sealing member 52 is installed between the upper surface of the inside block 28 and the inner cutter holder 40 of the oscillator 30 to prevent water from coming into the shaver main body 10.

Next, the outer cutter assembly 12 will be described.

The outer cutter assembly 12, as illustrated in FIG. 4, has three outer cutters 16*a*, 16*b* and 16*c* installed in an outer cutter frame 54 so that they can move up and down, and the outer circumference thereof is enclosed by the head cover 14 (FIGS. 1 and 2). The outer cutter frame 54, when the head cover 14 is secured to the shaver main body 10, is held and secured between the head cover 14 and the shaver main body 10.

At either end of the outer cutters 16*a* to 16*c*, spring loading chambers 58 are provided for respectively loading therein outer cutter downward pushing springs 56 which constitute outer cutter elastically supporting members in the present invention. These spring loading chambers 58 are guided by guides 60 projecting from the inner surfaces of two end plates 54*a* of the outer cutter frame 54, making it possible for the outer cutters 16*a* to 16*c* to move up and down. On the outer surface of each one of the two end plates 54*a* of the outer cutter frame 54, a slide member 62 is attached so that it can freely move up and down. More specifically, two engagement pawls 64 are formed to project from the each one of the outer surfaces of the end plates 54*a* of the outer cutter frame 54, and these engagement pawls 64 are brought to be engaged with long vertical slits 66 formed in the respective slide members 62.

On the upper edge of each one of the slide members 62, three horizontal projections 68 are formed (inwardly) that pass through the long vertical openings formed in each end plate 54*a* of the outer cutter frame 54 and advance horizontally into the spring loading chambers 58 for the outer cutters 16. These horizontal projections 68 engage with the upper ends of the outer cutter downward pushing springs 56 provided in the spring loading chambers 58 for the outer cutters 16. More specifically, the outer cutter downward pushing springs 56 are compressed in such a condition that the lower ends thereof are in contact with (or engaged with) the bottom surfaces of the spring loading chambers 58 while the upper ends thereof are in contact with (or engaged with) the horizontal projections 68 of the slide members 62.

A downward oriented return force is imparted to the slide members 62 by slide member downward pushing springs 70 which are compressed and installed between the outer cutter frame 54 and the slide members 62. More specifically, the lower end of each of the springs 70 is latched by a projection 72 formed at the center of the lower edge of each one of the slide members 62, while the upper end of the spring 70 is latched by a projection 74 formed at the center of the upper edge of each one of the end plates 54*a* of the outer cutter frame 54. These springs 70 exhibit a return force that is stronger than the combined spring forces of the downward pushing springs 56 for the three outer cutters. As a consequence, the slide members 62, while being subjected to an upward counterforce by the outer cutter downward pushing springs 56, are also subjected to a downward counterforce by these slide member downward pushing springs 70. Because the downward counterforce of the slide member downward pushing springs 70 is larger than the upward counterforce of the outer cutter downward pushing springs 56, the slide members 62 can stay at the descended positions.

More specifically, the slide members 62 stabilize at positions where the engagement pawls 64 of the end plates 54*a* of the outer cutter frame 54 are butted against the upper edges of the slits 66 of the slide members 62. This situation is shown in the left half of FIG. 2, in FIG. 3A, and in FIGS. 5 and 7. In this situation, the outer cutter downward pushing springs 56 are in the extended state; as a result, the force (F(OUT)) pushing the outer cutters 16*a* to 16*c* down is small. Accordingly, the difference from the upward pushing force (F(IN)) of the inner cutter upwardly pushing spring 46, the difference being F(TOT)=F(IN)−F(OUT), will become greater.

The height level of the slide members 62 is set by float setting members 76 provided in the shaver main body 10. As shown in FIGS. 4 and 6, the float setting members 76 are formed so that they rise upward from both ends of a horizontal plate 78 that is provided inside the back surface (wall) of the shaver main body 10 so as to be movable vertically or up and down. These float setting members 76 advance out and upward through vertical grooves formed in the shaver head buttons 20 so as to face the lower surfaces of the center of the lower edges of the slide members 62 (the lower surfaces of the projections 72). As a result, when the outer cutter assembly 12 is attached to the shaver main body 10 and locked to the shaver head buttons 20, the lower edges of the slide members 62 contact the upper edges of the float setting members 76, and the height of the float setting members 76 is thus fixed as shown in, for instance, FIGS. 3A and 3B.

A cam plate 80 formed with a diagonal cam channel 82 is secured to the horizontal plate 78. The diagonal cam channel 82 of the cam plate 80 is engaged to a projection 86 of a manual manipulator 84 that is mounted on the back surface of the shaver main body 10 so that it can slide horizontally. As a result, when the manual manipulator 84 is moved left and right as shown by arrows in FIG. 7, the cam plate 80 and the horizontal plate 78 are moved up and down due to the diagonal cam channel 82, and as a result the float setting members 76 are moved up and down.

When the manual manipulator 84 is moved to one side (for example to the left in FIG. 7), the float setting members 76 ascend. As a result, the slide members 62 are ascended, and the outer cutter downward pushing springs 56 extend. Accordingly, the spring force F(OUT) of the outer cutter downward pushing springs 56 becomes smaller, and the float pressure F on the outer cutters 16, which is F(TOT)=T(IN)−F(OUT), becomes larger, thus bringing a normal condition. When, conversely, the manual manipulator 84 is moved to the other side (to the right in FIG. 7), then the slide members 62 are descended, and the outer cutter downward pushing springs 56 are compressed and contract. Accordingly, the spring force F(OUT) on the outer cutter downward pushing springs 56 become larger, and the float pressure F(TOT) on the outer cutters 16 becomes smaller, so that a soft condition is brought, and the outer cutters 16 are moved up and down smoothly, nicely following the curved surfaces of the skin. In this situation, the pressure of contact between the inner cutters 50 and the outer cutters 16 will not change; as a result, such problems as changes in sharpness, loud noise, or a large amount of heat developing due to friction or the like, will not occur.

Next, a left-and-right pair of locking devices 100 will be described referring to FIGS. 8 to 11B.

Figure 8:
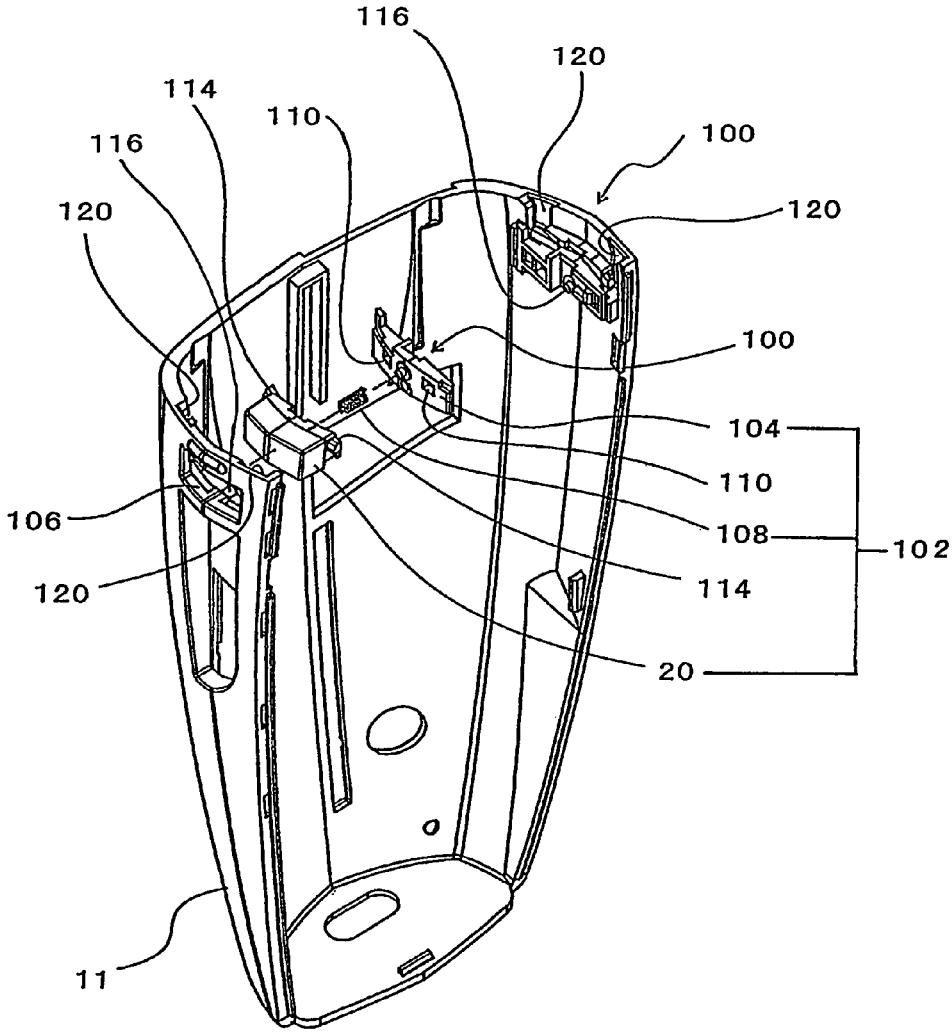
FIG. 8 is a disassembled perspective view showing the interior of a main body casing and the locking device.
Figure 9:
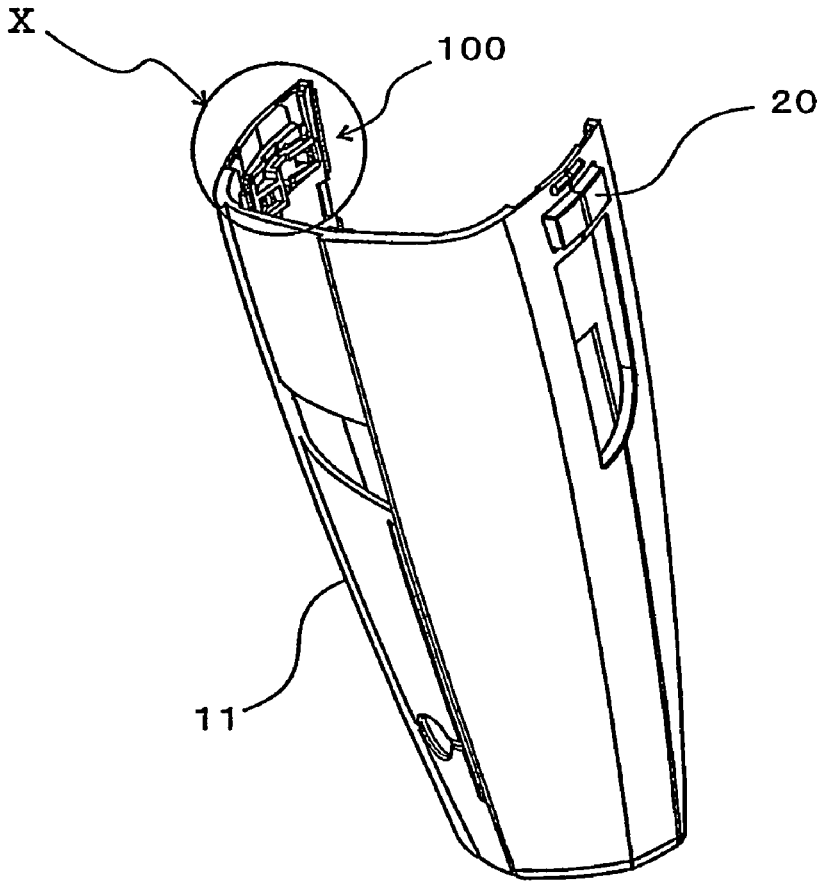
FIG. 9 is an external perspective view of the main body casing.

The locking devices 100 are for locking the outer cutter assembly 12 to the main body casing 11 so that the outer cutter assembly 12 is detachable with respect to the main body casing 11 of the shaver. FIG. 8 shows the interior of the disassembled main body casing 11 and locking devices 100, FIG. 9 shows the exterior of the main body casing 11, FIG. 10 is an enlarged view of the X portion in FIG. 9, and FIGS. 11A and 11B show the manner of the outer cutter assembly 12 to be attached to and detached from the main body casing 11, omitting the internal structure of the outer cutter assembly 12.

Each one of the locking devices 100, respectively provided at two (left and right) upper sides of the main casing 11, includes a pair of (or two) first engagement pawls 18, which are provided in the head cover 14 for the outer cutter assembly 12 (see FIGS. 11A and 11B), and a push button assembly 102, which is provided in the main body casing 11. The push button assembly 102 is, as seen from FIG. 8, comprised integrally of a back plate 104, which is secured to the inner surface of the main body casing 11, the above-described shaver head button 20, which constitutes a push button capable of protruding from each one of the openings 106 (see FIG. 8) provided in the main body casing 11, and a push button return spring 108, which is compressed between the back plate 104 and the shaver head button 20. More specifically, in each of the shaver head buttons 20, a pair of pawls 112 which engage a pair of small holes 110 formed in the back plate 104 are provided so as to protrude, and these pawls 112 of the shaver head button 20 are made to advance into and latch in the small holes 110 of the back plate 104 while compressing the push button return spring 108, so that the shaver head button 20 and the back plate 104 are formed into an integrated assembly to make the push button assembly 102.

In such an integrated state, each of the shaver head buttons 20 is capable of advancing and retracting within a prescribed range when the pawls 112 of the shaver head button 20 protrude to the rear side of the back plate 104 through the small holes 110 of the back plate 104. In each of the shaver head buttons 20, moreover, a left-and-right pair of second engagement pawls 114 are, as seen from FIG. 10, provided so as to protrude in a direction substantially perpendicular to the outer cutter attachment and detachment direction (vertical direction in FIG. 8) and substantially along the inner surface of the main body casing 11. As described above, the first engagement pawls 18 of the outer cutter assembly 12 are engaged with and disengaged from the second engagement pawls 114 of (each one of) the shaver head buttons 20 provided on the main body casing 11. The push button assemblies 102 are assembled in this way, and their back plates 104 are secured by being thermally bonded at 116 to the inner surface of the main body casing 11. When the push button assemblies 102 are thus provided on the main body casing 11, the shaver head buttons 20 protrude out from the openings 106 formed in the main body casing 11.

Figure 10:
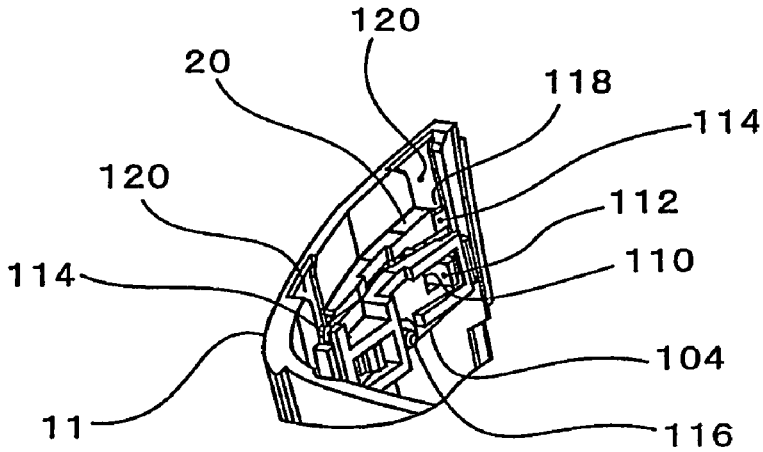
FIG. 10 is an enlarged view of the X portion of FIG. 9.
Figure 11A:
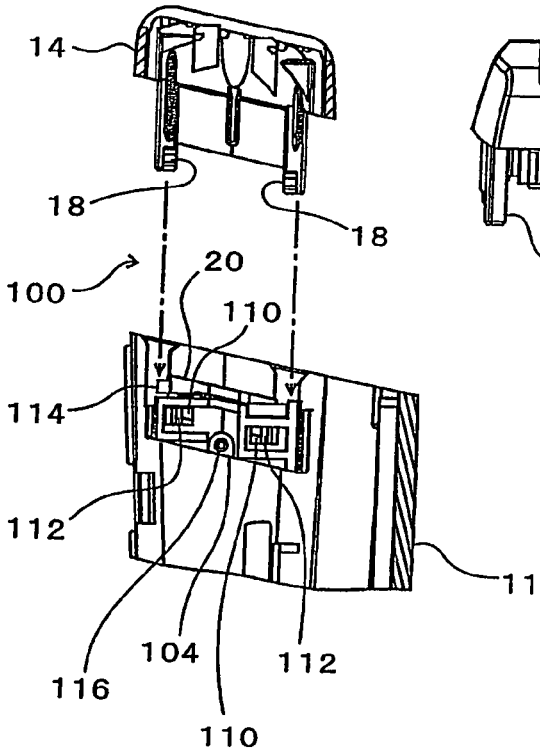
FIG. 11A shows in cross-section how an outer cutter assembly is attached and detached to the main body casing, FIG. 11B being a front elevational view of the outer cutter assembly.
Figure 11B:
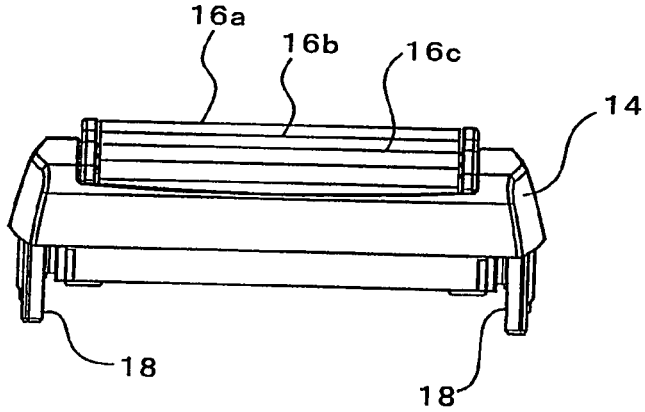

Furthermore, guide channels 120 are, as seen from FIGS. 8 and 10, formed in the inner surface of the main body casing 11. The guide channels 120 are provided so as to guide the first engagement pawls 18 of the outer cutter assembly 12 from the open edge of the main body casing 11 into gaps 118 (see FIG. 10) which are between the second engagement pawls 114 of the shaver head buttons 20 and the inner surface of the main body casing 11.

Because each one of the push button assemblies 102 is a single piece formed by the shaver head button 20, the back plate 104, and the push button return spring 108, it is only necessary to secure the assemblies 102 to the main body casing 11. Thus, the assembling efficiency of the locking devices (locking structures) 100 is high. This is because no push button return spring is installed in a compressed manner between the parts installed in the main body 10 and the push buttons (shaver head buttons 20), and the assembly work of the locking devices 100 can be done separately from the assembly work of the parts installed inside the shaver main body. Also, because the counterforce of the push button return spring is not taken by the main body casing 11 or by the parts of inside the main body 10, no reinforcing ribs are necessary for sustaining those forces, and die design freedom of, for instance, the main body casing increases.

The invention claimed is:

1. A locking device for securing an attachment member to a main body, comprising:

first engagement pawls provided in said attachment member, said first engagement pawls extending parallel to a direction of attachment-detachment of said attachment member and along an inner surface of said main body; and a separate push button assembly which is secured to the inner surface of said main body and provided with second engagement pawls that are engaged to and disengaged from said first engagement pawls; wherein said separate push button assembly is integrally comprised of:

a back panel transversely secured to said inner surface of said main body, said back panel further comprising a pair of holes provided therein, a push button protruding through an opening provided in said main body, said push button further comprising a pair of pawls, each of said pair of pawls extended rearwardly through and attaching into one of said pair of holes in said back panel, an amount of protrusion on said push button being limited, and said second engagement pawls being formed on said push button, and a push button return spring that is compressed and installed between said back panel and push button, wherein said main body is a main body casing for a reciprocating electric shaver, and said attachment member is an outer cutter assembly that is attached to and detached from said main body from above.

2. The locking device according to claim 1, wherein:

said first engagement pawls are provided in said outer cutter assembly so as to extend from an open edge of said main body casing along an inner surface of said main body casing;

the second engagement pawls of the push button assembly are substantially perpendicular to a direction of attachment and detachment of said outer cutter assembly and protrude in a direction along the inner surface of said main body casing;

said first engagement pawls, guided along the inner surface of said main body casing, intrude into a gap between the inner surface of said main body casing and said second engagement pawls, compress said push button return spring and are engaged with said second engagement pawls while push-opening said gap; and said second engagement pawls and said first engagement pawls are disengaged when said push button is pushed.

3. The locking device according to claim 2, wherein said inner surface of said main body casing is formed with guide channels for guiding said first engagement pawls of said outer cutter assembly into the gap between said main body casing inner surface and said second engagement pawls.

* * * * *